United States Patent [19]

Wurst

[11] Patent Number: 4,465,004

[45] Date of Patent: Aug. 14, 1984

[54] METHOD OF FORMING AN EYELET END BUTTONHOLE PATTERN

[75] Inventor: John W. Wurst, Chester Township, Morris County, N.J.

[73] Assignee: The Singer Company, Stamford, Conn.

[21] Appl. No.: 432,483

[22] Filed: Oct. 4, 1982

[51] Int. Cl.[3] ..... D05B 3/06

[52] U.S. Cl. ..... 112/264.1

[58] Field of Search ..... 112/430, 439, 264.1, 112/158 B, 431, 437, 432, 435, 266.1, 439

[56] References Cited

U.S. PATENT DOCUMENTS

| | | | |
|---|---|---|---|
| 273,727 | 3/1883 | Hallenbeck . | |
| 1,409,214 | 3/1922 | Einstein | 112/266.1 X |
| 1,483,184 | 2/1924 | McCann | 112/264.1 X |
| 1,560,634 | 11/1925 | Allen | 112/264.1 X |
| 2,977,913 | 4/1961 | Schenkengel . | |
| 4,188,900 | 2/1980 | Garron et al. . | |

*Primary Examiner*—Werner H. Schroeder
*Assistant Examiner*—Andrew M. Falik
*Attorney, Agent, or Firm*—David L. Davis; Robert E. Smith; Edward L. Bell

[57] ABSTRACT

A method of forming an eyelet end buttonhole pattern having two spaced apart rows of zig zag stitches joined at one end by a generally circular pattern of zig zag stitches includes first forming a single stitch in the eyelet end, then feeding the fabric in the forward direction until the stitch forming point is at the other end of the buttonhole pattern from where the initial stitch was placed. A side bar is then stitched, beginning in reverse, proceeding around the eyelet end, then in a forward direction to the other end of the pattern. The feeding is then reversed and the stitching retraces the buttonhole pattern in the opposite direction. Barring stitches are then sewn, to close and finish the buttonhole pattern with a square end.

4 Claims, 2 Drawing Figures

METHOD OF FORMING AN EYELET END BUTTONHOLE PATTERN

DESCRIPTION

BACKGROUND OF THE INVENTION

This invention relates to a method of sewing a buttonhole pattern and, more particularly, to an improved method of sewing an eyelet end buttonhole pattern having uniform stitch density and wherein sewing of the pattern is initiated on the end of the buttonhole nearest the edge of the garment.

When sewing an eyelet end, or keyhole, buttonhole pattern, there are a number of factors, some essential and some desirable, which must be considered. Thus, the eyelet end of the buttonhole pattern must be nearer the edge of the garment than the square end of the buttonhole pattern. However, since the eyelet end is decorative, it is desirable to be able to start and finish the sewing at the square end where the tieing stitches are substantially unnoticable amongst the barring stitches. It is also essential, when a row of such buttonhole patterns are sewn along the edge of a garment, that the eyelet end of all of the buttonholes be positioned the same distance from the edge of the garment. Highly desirable factors are that the buttonhole pattern have a uniform stitch appearance in spite of the fact that some of the stitches are sewn when feeding in the forward direction and some of the stitches are sewn when feeding in the reverse direction. It is also desirable to be able to adjust the overall length of the buttonhole pattern. Additionally, since the keyhole buttonhole pattern is typically sewn on a relatively heavy garment, such as a jacket, it is desirable, especially on a household sewing machine, to be able to sew the entire buttonhole pattern without turning the garment.

It is therefore an object of the present invention to provide an improved method of forming an eyelet end buttonhole pattern which satisfies the above-mentioned factors.

SUMMARY OF THE INVENTION

The foregoing and additional objects are attained in accordance with the principles of this invention by providing a method of operating a zig zag sewing machine to produce an eyelet end buttonhole pattern on a work material, the eyelet end buttonhole pattern including two spaced apart parallel rows of zig zag stitches joined at one end by a generally circular pattern of zig zag stitches. The pattern is sewn by first forming a single stitch at a predetermined position with respect to the round end of the buttonhole, and then feeding the work material in the forward direction, without forming stitches, until the stitch forming point is at the other end of the buttonhole from where the initial stitch was placed. A first of the parallel rows is then stitched in the reverse feeding direction until the one end is reached, and then the generally clrcular pattern is sewn starting at that one end of the first row. At the end of the generally circular pattern, the other of the parallel rows is sewn in the forward direction starting at that one end and proceeding to the other end thereof. The direction of feed is then reversed and the second row, the generally circular pattern, and the first row are then resewn in the opposite feeding direction from that of the previous sewing. Lastly, barring stitches are sewn to define the square end of the buttonhole pattern. This sequence of stitching is advantageous because stitching of the eyelet end of the buttonhole pattern is continuous, with closure occurring in the bar tack area where it is readily concealed. Additionally, the stitch density appears uniform because each leg has a layer of forward and reverse stitches.

BRIEF DESCRIPTION OF THE DRAWINGS

The foregoing will be more readily apparent upon reading the following description in conjunction with the drawings in which.

DESCRIPTION OF THE PREFERRED EMBODIMENT

Figure 1:
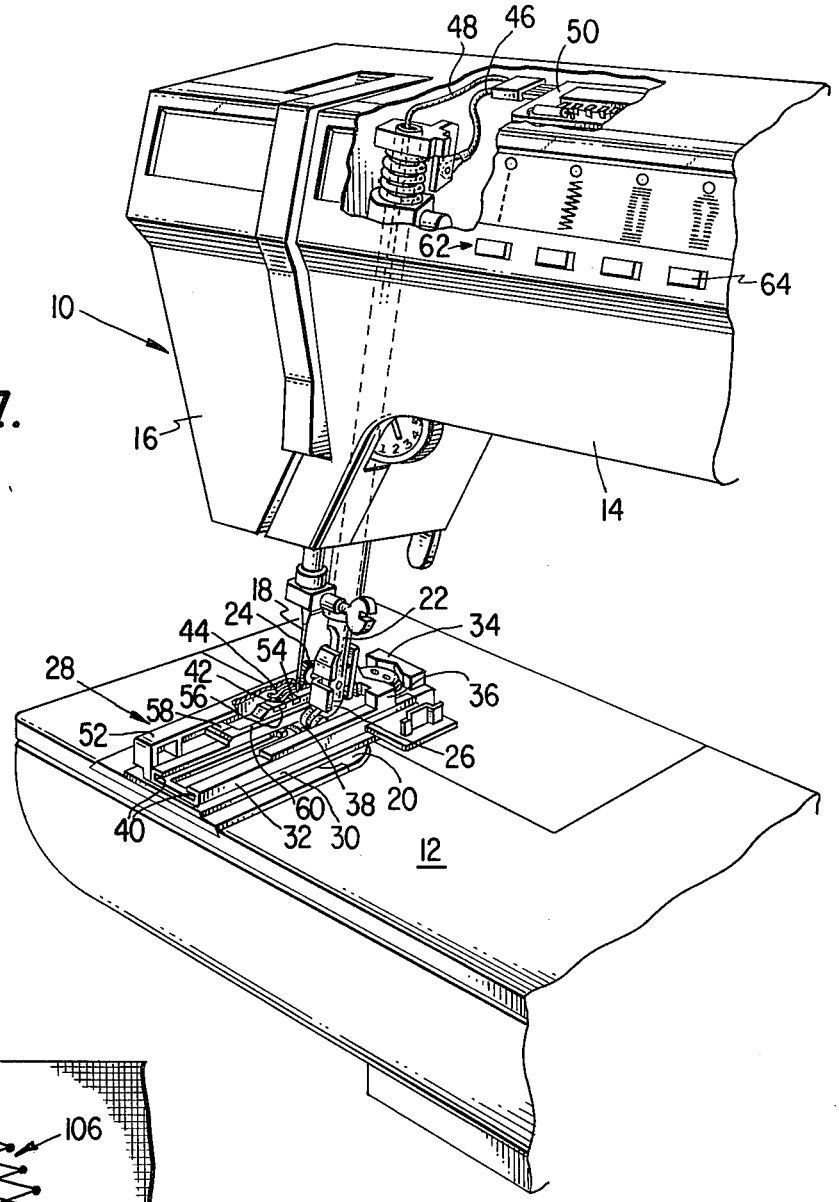
FIG. 1 is a perspective view of a portion of a sewing machine in which the method according to this invention may be practiced.

Referring now to the drawings, FIG. 1 shows a portion of a sewing machine designated generally by the reference numeral 10. The sewing machine 10 includes a work supporting bed 12, a bracket arm 14 and a sewing head 16. The sewing machine stitch forming instrumentalities include a needle 18 capable of being endwise reciprocated and laterally jogged to form zig zag stitches and a work feed dog (not shown) operating upwardly through slots formed in a throat plate 20 on the bed 12 to transport work across the bed 12 between needle penetrations.

Journalled in the sewing head 16 is a presser bar 22 having a clamp screw 24 for retaining thereto the shank portion 26 of a buttonhole presser device designated generally by the reference numeral 28. The buttonhole presser device 28 is preferably of the form disclosed in copending U.S. patent application Ser. No. 411,148, filed Aug. 25, 1982, U.S. Pat. No. 4,409,913 and assigned to the assignee of the present invention. As is fully described in the referenced application, the presser device 28 is a modified version of the presser device disclosed in U.S. Pat. No. 3,877,403. Accordingly, the presser device 28 includes a work engaging plate 30 and a work engaging shoe 32, between which is captured the work material in which the buttonhole pattern is to be sewn, as is well known in the art. The presser device 28 also includes a button gauging arrangement including an anchor element 34 and a slidable button gauging element 36. The presser device 28 further includes a slidable foot element 38 to which the shank 26 is pivotally fastened and which is slidably mounted between tracks 40 of the shoe 32 to permit movement of the presser device 28 along the line of material feed. A pair of switch contact members 42 and 44 are carried by the shank 26 and are electrically connected, as disclosed in the referenced application, to the wires 46 and 48 connected to the control circuitry 50 of the sewing machine 10. The slide contacts 42 and 44 ride within a protective channel 52 which has contact closing members mounted thereon and movable therewith. Illustratively, these contact closing members take the form of conductive bars 54 and 56. A further contact closing member, illustratively a conductive bar 58 is mounted on a guide rail 60 connected to the button gauging element 36. Thus, as the work engaging shoe 32 moves relative to the presser foot 38, the conductive bars 54, 56 and 58 in turn close an electrical circuit path between the switch contact members 42 and 44.

As shown in FIG. 1, the sewing machine 10 includes a pattern selection panel 62 illustratively including a plurality of push button switches for operator selection of a pattern to be sewn. In particular, the push button switch 64 is utilized by the sewing machine operator to select formation of an eyelet end buttonhole pattern which is then sewn in accordance with the principles of this invention. Specifically, for illustrative purposes, the eyelet end buttonhole pattern is a keyhole buttonhole pattern which includes two spaced apart parallel rows of zig zag stitches joined at one end by a generally circular pattern of zig zag stitches. For the keyhole pattern, the generally circular pattern has an overall width greater than the overall width of both of the rows of zig zag patterns plus the space between the rows. At the other end of the parallel rows, barring stitches are formed to join the two rows into a square end.

Figure 2:
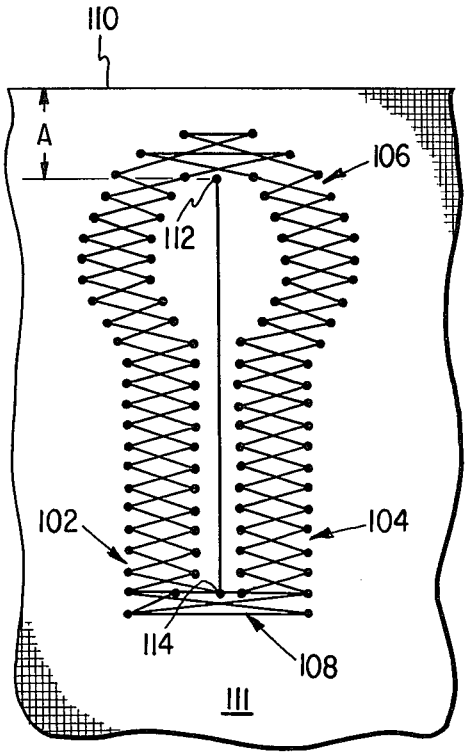
FIG. 2 is a representation of a buttonhole pattern sewn in accordance with this invention.

Referring now to FIG. 2, shown therein is a keyhole buttonhole pattern sewn in accordance with the principles of this invention. This buttonhole pattern includes two spaced apart parallel rows 102 and 104 formed of zig zag stitches. The rows 102 and 104 are joined at one end by a generally circular pattern 106, also formed of zig zag stitches. The generally circular pattern 106 illustratively has an overall width greater than the overall width of both rows 102 and 104 plus the space between the rows 102 and 104. At the other end of the rows 102 and 104, the rows are joined by a group of zig zag barring stitches 108. Initially, the operator positions the work material in which the pattern is being sewn so that the edge 110 of the work material 111 is a predetermined distance "A" from the stitching point. When sewing is begun, assuming of course that the keyhole buttonhole pattern selection button 64 has been actuated, the sewing machine forms an initial stitch at the point 112. This point is at a predetermined position with respect to the circular pattern 106. Illustratively, it is at the inner edge of the circular pattern closest to the edge 110. The sewing machine then feeds the work material, without forming stitches, in the forward direction to a point 114 which defines the other end of the rows 102 and 104. When the initial stitch is formed at the point 112, the presser device 28 is positioned so that the sliding contacts 42 and 44 are shorted by the conductive bar 54. The sewing machine control circuitry 50 is programmed to ignore this condition. During the nonstitch forming feeding operation to the point 114, the sliding contacts 42 and 44 are shorted by the conductive bar 56. The control circuitry is programmed to ignore this. However, the control circuitry recognizes the shorting caused by the conductive bar 58 and terminates this feeding operation. The sewing machine, upon recognizing shorting of the sliding contacts 42 and 44 by the conductive bar 58, initiates sewing of the row 102 of zig zag stitches in the reverse direction until a shorting of the switch contact members 42 and 44 by the conductive bar 56 is sensed. At this point, the generally circular pattern 106 is sewn starting from the row 102 and then the row 104 of zig zag stitches is sewn until shorting of the sliding contacts 42 and 44 by the conductive bar 58 is sensed. The sewing machine control circuitry is programmed to ignore any intermediate shortings of the sliding contacts 42 and 44 by the conductive bars 54 and 56. The row 104 is then resewn in the reverse direction until shorting of the sliding contacts 42 and 44 by the conductive bar 56 is sensed. At this point, the generally circular pattern 106 is sewn in the direction opposite to that in which it has previously been sewn and the row 102 is sewn in the forward direction until the shorting of the sliding contacts 42 and 44 by the conductive bar 58 is sensed. At this time, the zig zag barring stitches 108 having an overall width equal to the overall width of both the rows 102 and 104 plus the space between the rows are sewn.

To change the length of the eyelet end buttonhole pattern, the position of the conductive bar 58 relative to the conductive bar 56 is adjustable via the button gauging element 36. This controls the length of the rows 102 and 104, the sewing machine control circuitry 50 being programmed to sew a fixed size generally circular pattern 106.

Accordingly, there has been disclosed an improved method of sewing an eyelet end buttonhole pattern. This pattern has the desirable characteristic of uniform stitch appearance because it is sewn in both directions of feed so that any feed imbalance is canceled. Additionally, the eyelet end is nearest the edge of the work material but the pattern is started and finished at the square end where such starting and finishing is not noticeable. Further, any change in overall length of the pattern takes place in the straight portion so the eyelet end is not affected. It is understood that the above-described method is merely illustrative of the application of the principles of this invention, and it is only intended that the invention be limited by the scope of the appended claims. For example, this invention may be practiced when, sewing a satin stitch pattern having both forward and reverse directions of feed so as to achieve uniform stitch density.

I claim:

1. A method of operating a zig zag sewing machine to produce an eyelet end buttonhole pattern on a work material, said eyelet end buttonhole pattern including two spaced apart parallel rows of zig zag stitches joined at one end by a generally circular pattern of zig zag stitches, said method comprising the steps of:

sewing a first of said parallel rows in a first direction towards said one end;

sewing said generally circular pattern starting at said one end of said first row;

sewing the second of said parallel rows in a second direction away from said one end;

sewing said second row in said first direction towards said one end;

sewing said generally circular pattern starting at said one end of said second row; and sewing said first row in said second direction away from said one end.

2. The method according to claim 1 further including the step of:

sewing a plurality of zig zag barring stitches at the other end of said rows of an overall width equal to the overall width of both said rows plus the space therebetween.

3. The method according to claim 1 further including the initial steps of:

sewing a single stitch at a predetermined position with respect to the circular pattern; and feeding the work material in said second direction to a point which defines the other end of said parallel rows.

4. The method according to claim 1 wherein all changes in overall length of the pattern occur in the length of said rows.

* * * * *